US011123891B2

(12) United States Patent
Supe-Dienes

(10) Patent No.: US 11,123,891 B2
(45) Date of Patent: Sep. 21, 2021

(54) BLADE HOLDER WITH ADJUSTING SLIDE

(71) Applicant: Dienes Werke für Maschinenteile GmbH & Co. KG, Overath (DE)

(72) Inventor: Rudolf Supe-Dienes, Overath (DE)

(73) Assignee: Dienes Werke für Maschinenteile GmbH & Co. KG, Overath (DE)

( * ) Notice: Subject to any disclaimer, the term of this patent is extended or adjusted under 35 U.S.C. 154(b) by 0 days.

(21) Appl. No.: 16/850,209

(22) Filed: Apr. 16, 2020

(65) Prior Publication Data

US 2020/0238553 A1 Jul. 30, 2020

Related U.S. Application Data

(63) Continuation-in-part of application No. 16/053,549, filed on Aug. 2, 2018, now abandoned.

(30) Foreign Application Priority Data

Aug. 2, 2017 (DE) ..... 10 2017 117 524.5

(51) Int. Cl.
*B26D 1/06* (2006.01)
*B26D 7/26* (2006.01)

(52) U.S. Cl.
CPC *B26D 1/06* (2013.01); *B26D 7/26* (2013.01)

(58) Field of Classification Search
CPC ... B26D 1/01; B26D 1/04; B26D 1/06; B26D 1/065; B26D 1/08; B26D 1/085; B26D 1/09; B26D 1/095; B26D 1/10; B26D 1/14; B26D 1/26; B23D 45/26; B23D 45/2614; B23D 45/2621; B23D 45/00; B23D 45/02; B23D 45/022; B23D 45/024
See application file for complete search history.

(56) References Cited

U.S. PATENT DOCUMENTS 3,646,418 A * 2/1972 Sterns ..... B26D 7/2635 318/603
3,834,258 A * 9/1974 Zumstein ..... C03B 33/037 83/884
3,892,156 A * 7/1975 Johnstone ..... B23D 35/004 83/469

(Continued)

OTHER PUBLICATIONS https://www.merriam-webster.com/dictionary/transverse (Year: 2020).*

*Primary Examiner* — Stephen Choi
*Assistant Examiner* — Richard D Crosby, Jr.
(74) *Attorney, Agent, or Firm* — Johnson, Marcou, Isaacs & Nix, LLC; Jennifer S. Stachniak, Esq.

(57) ABSTRACT

A blade holder (1) for a longitudinal cutting machine includes a rotatably mounted blade head (3) for holding a circular blade (4) and at least one locking device (2). At least one actuator actuates an element of the blade holder (1), and a moveably mounted adjusting slide (5) positions the blade head (3) on the longitudinal cutting machine. The adjusting slide (5) for positioning of the blade head (3) is moveable from a starting position to a positioning point. With the blade holder, materials can be cut perfectly with high precision. In particular, materials such as tissue, non-woven materials, paper, OLED film, displays, battery film, lithium batteries, aluminum, copper film, anodes, and cathodes can be cut.

9 Claims, 7 Drawing Sheets

(56) References Cited

U.S. PATENT DOCUMENTS

| | | | | | |
|---|---|---|---|---|---|
| 4,033,217 | A * | 7/1977 | Flaum | B26D 7/2635 | 83/425.4 |
| 4,438,673 | A * | 3/1984 | Noffke | B26D 5/02 | 83/502 |
| 4,570,518 | A * | 2/1986 | Burmeister | B26D 1/225 | 83/504 |
| 4,649,782 | A * | 3/1987 | Cavagna | B26D 5/04 | 83/425.4 |
| 5,090,281 | A * | 2/1992 | Paulson | B24B 3/368 | 83/13 |
| 5,125,300 | A * | 6/1992 | Miller | B26D 7/2635 | 83/13 |
| 5,125,301 | A * | 6/1992 | Miller | B26D 7/2635 | 83/13 |
| 6,327,950 | B1 * | 12/2001 | Huhn | B26D 7/2628 | 83/481 |
| 6,868,766 | B1 * | 3/2005 | Sellers | B26D 5/04 | 144/237 |
| 7,757,594 | B2 * | 7/2010 | Supe-Dienes | B26D 7/2635 | 83/498 |
| 8,047,110 | B2 * | 11/2011 | Pappas | B26D 7/2635 | 83/481 |
| 8,210,079 | B2 * | 7/2012 | Myers | B26D 1/185 | 83/498 |
| 2003/0228197 | A1 * | 12/2003 | Salvaryan | B23D 47/04 | 407/30 |
| 2017/0157789 | A1 * | 6/2017 | Dinger | B26D 5/00 | |
| 2019/0039156 | A1 * | 2/2019 | Supe-Dienes | B26D 7/2635 | |

* cited by examiner

BLADE HOLDER WITH ADJUSTING SLIDE

CROSS-REFERENCE TO RELATED APPLICATION

This application is a continuation-in-part application of and claims priority to U.S. patent application Ser. No. 16/053,549, filed Aug. 2, 2018, which claims the priority date of Aug. 2, 2017, the filing date of the German patent application DE 10 2017 117 524.5. The complete disclosures of the above-identified priority applications are hereby fully incorporated herein by reference.

BACKGROUND OF THE INVENTION

The present invention relates to a blade holder for a longitudinal cutting machine, with a rotatably mounted blade head for holding a circular blade, with at least one fixing device, in particular, for fixing the blade holder to a traverse of the longitudinal cutting machine, with at least one actuator for actuation of an element of the blade holder, in particular for actuating the blade head, i.e. moving the blade head forth and back, and with a moveably mounted adjusting slide for, in particular, manual positioning of the blade head relative to the longitudinal cutting machine, whereby the adjusting slide is moveable from a starting position into a positioning position for positioning of the blade head.

Applicant offers under the phrase "easy set" blade holders with the above-described features. For example, Applicant provides a blade holder with the type designation PSGm 25 DF and PSGm 19 DF, which can be equipped with an adjusting slide. The adjusting slide is folded/pivoted downward for an exact positioning of the blade holder or blade head, so that a part of the adjusting slide can be brought into contact with a cutting edge of a lower blade of the longitudinal cutting machine, so that the circular blade of the blade holder is aligned with the lower blade. For example, for this positioning/alignment, the blade holder can be displaced along the traverse or the blade head can be manually adjusted with regard to the fixing device of the blade holder. In this manner, an exact position/alignment of the circular blade of the blade holder to the lower blade, in particular along the traverse, is possible. In the prior art, if the blade head of the positioned blade holder is lowered automatically (i.e. by the actuator) for the cutting process, it was shown that the adjusting slide, which is not moved back inadvertently into its starting position, can negatively affect the cutting process.

SUMMARY OF THE INVENTION

An object of the present invention, therefore, is to resolve the disadvantages associated with the state of the art and in particular, to provide a blade holder, whose adjusting slide cannot impede the cutting process.

The object is solved, in particular, by a blade holder with the above-noted features, whereby the adjusting slide is coupled with a mechanism for preventing (i.e., locking or blocking) actuation of the blade holder as soon as the adjusting slide is moved out of its starting position, as will be described below.

It is provided, in particular, that the blade holder or its elements cannot be actuated, for example, by a superordinate control unit, as long as the adjusting slide is moved out of its starting position. Thus, the blade holder only can be used for a cutting process when the adjusting slide is (manually) moved back again into its starting position after positioning/adjusting/aligning of the blade head towards the lower blade. In this manner, the lower blade is prevented from being damaged by the adjusting slide that has moved out of its starting position during an adjusting/aligning/positioning process of the blade head.

For positioning/adjusting/aligning of the blade head, first the fixing device can be released, so that the blade head is moveable, if necessary commonly with the entire blade holder, relative to the longitudinal cutting machine, and in particular, to a lower blade of the longitudinal cutting machine. Next, the adjusting slide is moved preferably manually from its starting position, in particular, folded out and/or pivoted out, so that the adjusting slide extends in the direction of the lower blade and preferably is arranged laterally near a cutting edge of the lower blade. In this positioning position of the adjusting slide, the blade holder or its blade head is moved until the adjusting slide, for example, with a contact element, comes into contact with the cutting edge or another reference surface of the lower blade. In this contact position, an exact orientation/alignment of the blade head relative to the lower blade is provided, so that the fixing device can again be tightened.

The adjusting slide, in particular, is mounted on the blade holder such that it can be moved only manually from the starting position into the positioning position and back. As explained above, in the positioning position, the adjusting slide can be brought into contact with a reference mark by movement of the entire blade holder by moving the blade holder or its blade head, so that the blade holder is aligned toward the reference mark. In contrast, with the movement of the adjusting slide from the starting position into the positioning position, the blade holder is not moved relative to another element of a longitudinal cutting machine.

The fixing device of the blade holder can include, for example, a dovetail guide with a clamping element, with which dovetail guide the blade holder can be moved along a corresponding traverse, in particular, manually, whereby the blade holder is fixed by means of the clamping element into a position on the traverse. After positioning/adjusting/aligning of the blade holder in the axial direction of the traverse and thus, after positioning of the blade head, the blade holder is fixed to the traverse, in particular, by means of the clamping element of the fixing device.

Alternatively, when the adjusting slide is in its positioning position, it can be provided that the blade head is moved preferably manually relative to a housing of the blade holder, which housing is connected with the traverse. For example, the blade head can be lowered, until reaching a particular vertical distance relative to the lower blade, which vertical distance is predetermined by the adjusting slide in its positioning position being in contact with the cutting edge or another reference surface of the lower blade. Therefore, in this case the fixing device serves for fixing of the blade head relative to a housing of the blade holder. In principal, multiple fixing devices can be provided. Nevertheless, after the adjusting slide is moved back into its starting position, the blade head can be actuated (automatically) by the actuator.

The blade head can be delivered ("actuated") linearly towards the lower blade before starting the cutting process, for example, automatically by means of a first actuator that preferably can be electro-mechanically, hydraulically, or pneumatically actuated. For example, the actuator upon receiving respective signals from a control unit can move the blade head linearly back and forth. Therefore, the movement of the blade head initiated by the actuator takes place in particular, obliquely to an axis of rotation of the blade head. The actuator must be connected to a power supply in order to move the blade head.

In addition or alternatively, it can be provided that the blade head is delivered ("actuated") by means of a further actuator that preferably can be electro-mechanically, hydraulically or pneumatically actuated in the direction of the extension of the traverse towards a cutting edge of the lower blade, whereby this movement of the blade head initiated by the actuator, in particular, takes place in the direction of the axis of rotation of the blade head.

With such blade holders, materials can be cut perfectly with high precision. In particular, materials such as tissue, non-woven material, paper, OLED film, displays, battery films, lithium batteries, aluminum, copper film, anodes or cathodes can be cut.

As noted above, a mechanism is provided that prevents (i.e., locks or blocks) actuation of the blade holder as soon as the adjusting slide is moved out of its starting position. In particular, for example, it can be provided that the mechanism works mechanically, when the adjusting slide is moved out from its starting position. For example, the mechanism may include a locking element that can be moved by the adjusting slide, the locking element engaging in the potential path of motion of the element of the blade holder to be locked. Alternatively, a locking element of the mechanism can be brought into engagement with a corresponding recess of an associated element of the blade holder. Therefore, the mechanism blocks the element in order to prevent it from actuating. In particular, the locking element as part of the mechanism can act on the blade head or a part connected to the blade head, so that the blade head cannot be moved automatically by the actuator.

A mechanical interruption of the energy supply of the actuator is likewise conceivable for embodying the mechanism to prevent actuation of the blade holder. For example, an electrical energy supply can be mechanically interrupted by a relay. In case of a pneumatic energy supply, the supply of pressurized air can be interrupted mechanically by mechanically blocking the supply of pressurized air.

It also can be provided that the mechanism works electrically and/or electronically when the adjusting slide is moved out from its starting position. By means of the adjusting slide being moved out from its starting position, for example, an actuation of an actuator of the blade holder that adjusts the element could be prevented at least indirectly. Thus, the electrical or pneumatic energy supply, for example, for actuating an actuator can be interrupted electrically or electronically, when the adjusting slide is moved out from its starting position. Accordingly, the mechanism prevents/stops the automatic actuation of the blade holder, when the adjusting slide is moved out of its starting position.

Accordingly, as described above the mechanism can be embodied such that an energy supply to at least one of the multiple actuators of the blade holder is interrupted mechanically, electrically or electronically, if necessary.

It also can be provided that the mechanism works pneumatically or hydraulically when the adjusting slide is moved out from its starting position. For example, by means of the adjusting slide, pneumatics for actuation of a locking element of the mechanism can be triggered, the locking element engaging in the potential path of motion of the element of the blade holder to be blocked.

In particular, it is also contemplated that a switch can be provided, which is constructed and arranged so that it is activated by the adjusting slide as soon as the adjusting slide is moved out of its starting position, whereby the activated switch triggers the (above described) mechanism. The mechanism, therefore, is directly activated/triggered via the switch. For example, the switch is (i.e. electronically) connected to the above described locking element or to a drive of the locking element, so that the locking element is triggered/driven, when the switch is activated.

In principal, the adjusting slide can be displaceable linearly from the starting position into its positioning position; however, it is preferable that the adjusting slide is pivotably mounted.

The invention relates also to a longitudinal cutting machine with a plurality of blade holders according to the present invention, whereby the blade holders are held as upper blades on a continuous traverse of the longitudinal cutting machine and the multiple blade holders are associated with at least one lower blade, preferably each upper blade is associated with a lower blade.

In this connection, it can be provided that the actuation of the entire longitudinal cutting machine is prevented by the mechanism when the adjusting slide of one individual blade holder is moved out from its starting position. This can be achieved, for example, if the adjusting slide and the therewith coupled mechanism of each blade holder is coupled with a superordinate control of the longitudinal cutting machine.

BRIEF DESCRIPTION OF THE DRAWINGS

The invention and the technical field are described next with reference to the figures. In the figures.

DETAILED DESCRIPTION OF THE PREFERRED EMBODIMENTS

Figure 1:
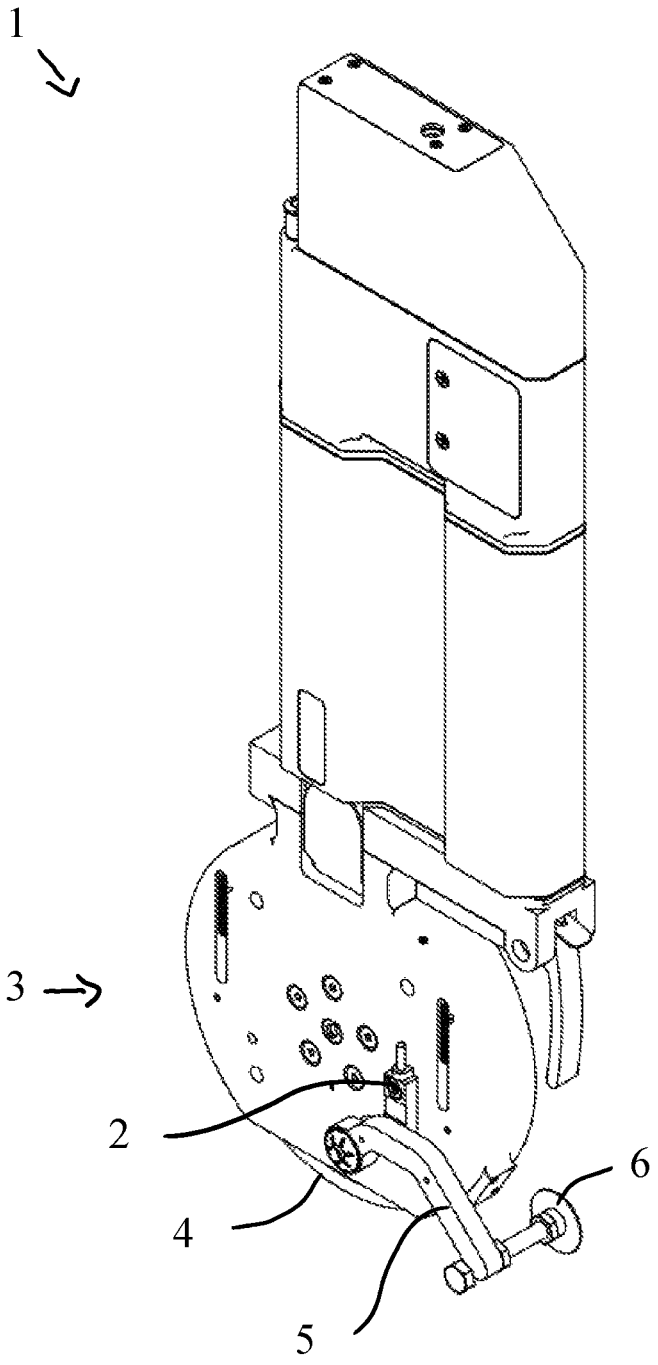
FIG. 1 shows a perspective view of a blade holder with an adjusting slide in a starting position.

The blade holder 1 shown in the figures includes a fixing device 15, with which the blade holder 1 is displaceable along a traverse 13 of a longitudinal cutting machine 7 and with which the blade holder 1 can be fixed to the traverse 13. For this, the fixing device 15 includes a dovetail guide 16, with which the blade holder 1 can be displaced linearly along the traverse 13. The fixing device 15 further includes a clamping element 17, with which the blade holder 1 can be fixed at a desired location on the traverse 13.

The blade holder 1 also includes a blade head 3, to which a circular blade 4 is attached. The blade head 3 can be lowered by means of an actuator 8 having an energy supply 12. The blade head 3 can be moved linearly towards a lower blade 9 automatically by means of the actuator 8. The actuator 8 can be actuated electro-mechanically, hydraulically, or pneumatically. For example, the actuator 8 upon receiving respective signals from a control unit can move the blade head 3 linearly up and down.

Figure 2:
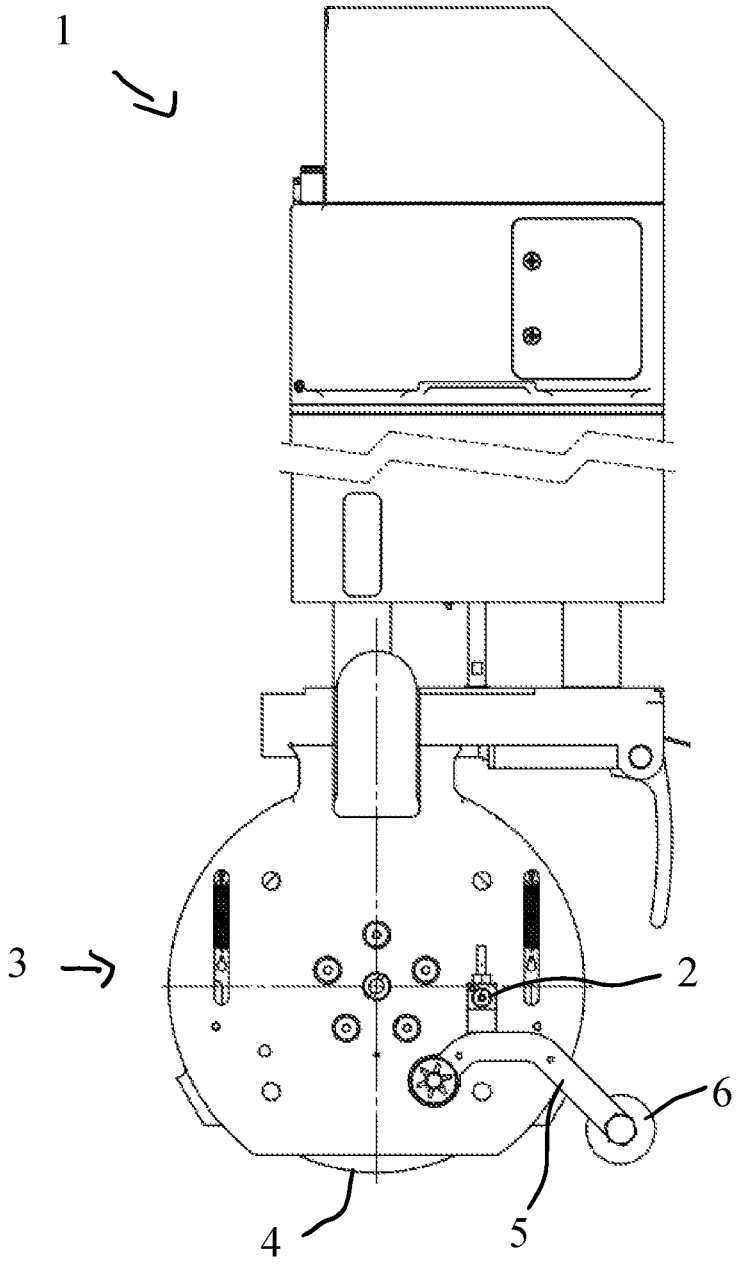
FIG. 2 shows a side view of the blade holder according to FIG. 1.
Figure 3:
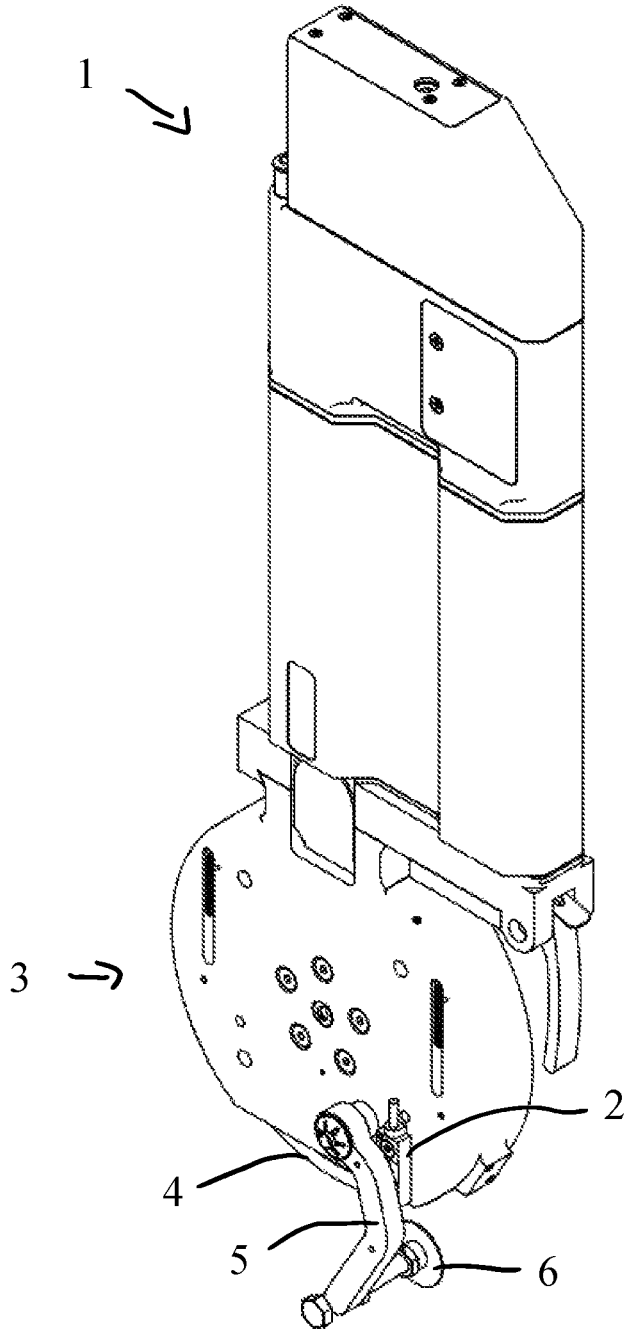
FIG. 3 shows a perspective view of the blade holder with the adjusting slide pivoted out from the starting position.
Figure 4:
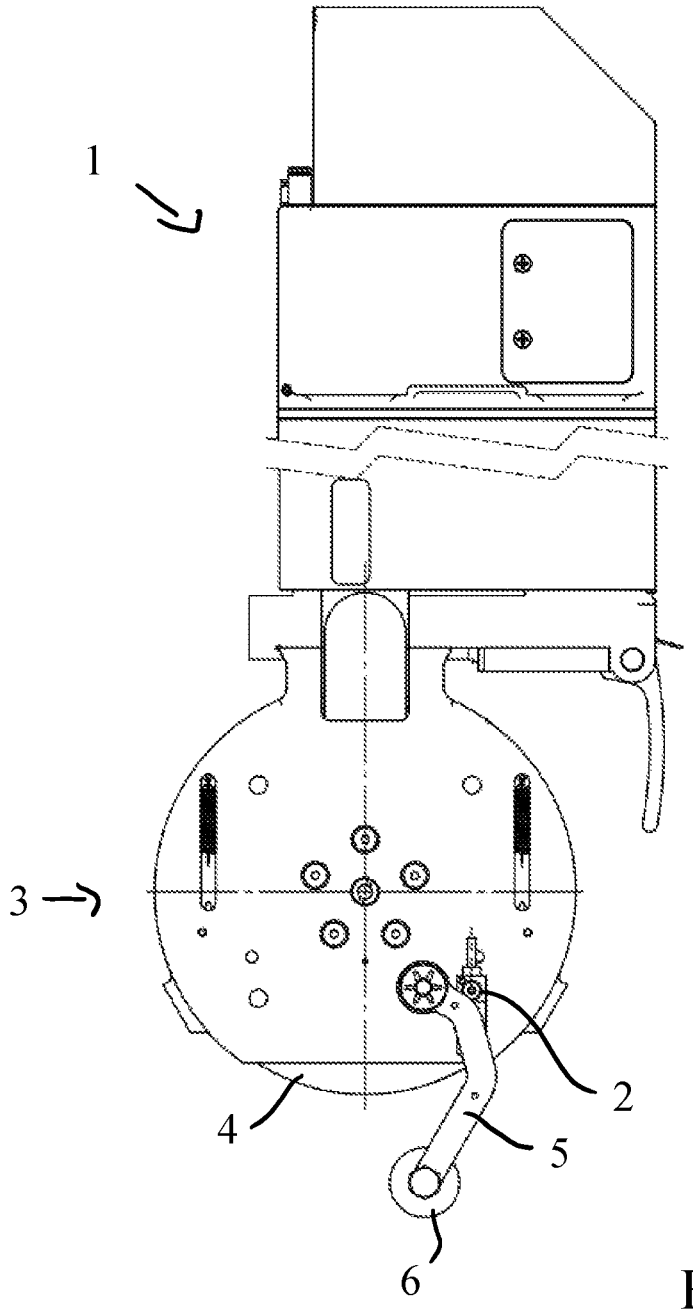
FIG. 4 shows a side view of the blade holder according to FIG. 3.
Figure 5:
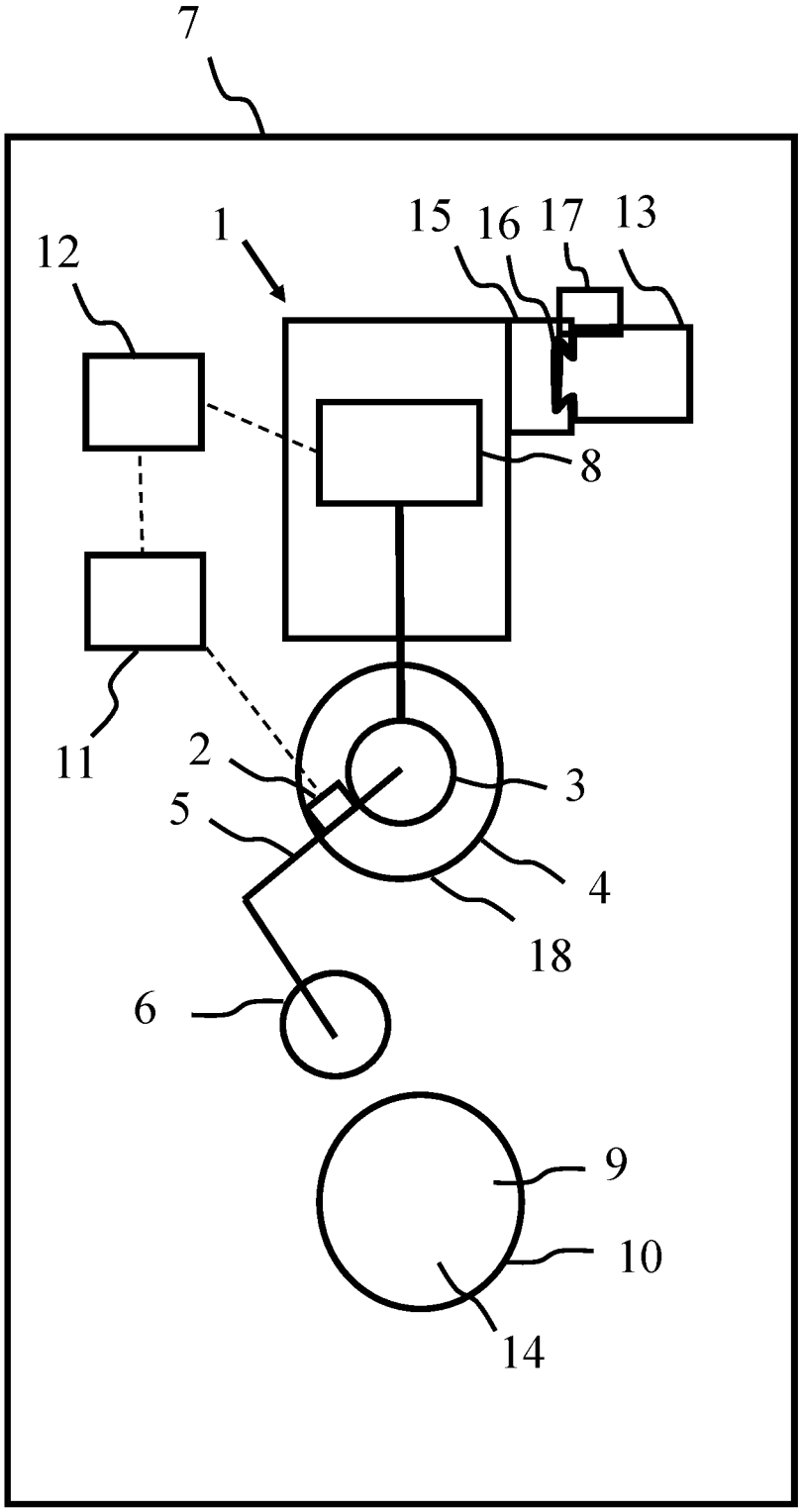
FIG. 5 shows a schematic cross-sectional view through a longitudinal cutting machine with one blade holder and one lower blade.
Figure 6:
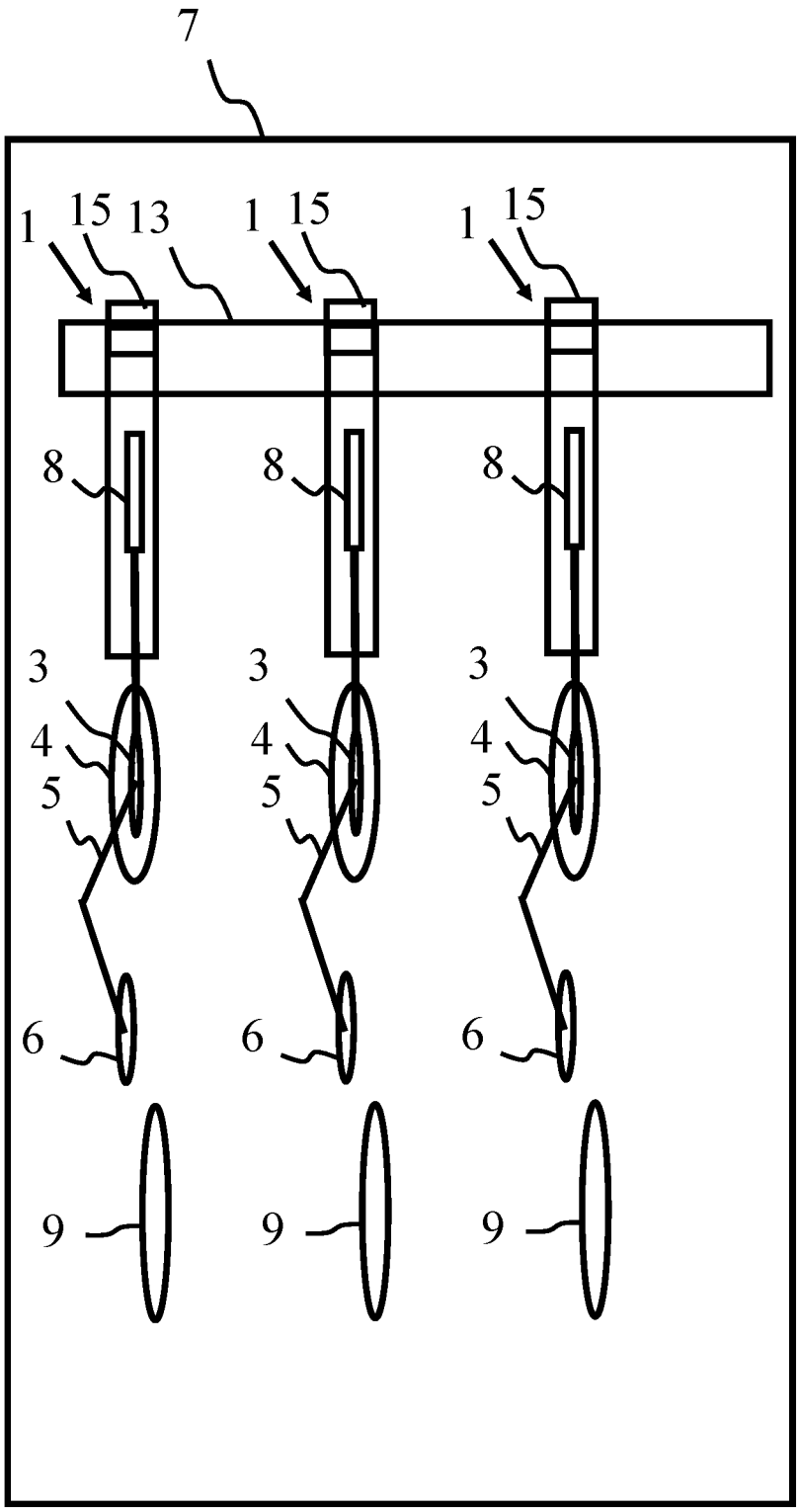
FIG. 6 shows a schematic front view of a longitudinal cutting machine having a plurality of blade holders and a plurality of lower blades.

The blade holder 1 also includes an adjusting slide 5 for positioning the blade holder 1 on the traverse 13. The adjusting slide 5 has a contact element 6, whose relative vertical position corresponds with the position of the cutting edge 18 of the circular blade 4. The starting position of the adjusting slide 5 is shown in FIGS. 1 and 2.

For positioning of the blade holder 1 on the traverse 13, the adjusting slide 5 is pivoted downward into its positioning position. When the adjusting slide 5 is in its positioning position, the clamping element 17 of the fixing device 15 is untightened and the entire blade holder 1 is moved along the traverse 13 until the contact element 6 is aligned (brought into contact) with a cutting edge 10 of the lower blade 9 or with another reference surface 14 of the lower blade 9 (see FIGS. 3-6). In the aligned state, also the blade head 3 and the circular blade 4 are aligned with the lower blade 9. After this alignment the clamping element 17 of the fixing device 15 is tightened and thereby the blade holder 1 is fixed to the traverse 13 again. Also, the adjusting slide 5 is pivoted back into its starting position. This alignment movement of the blade holder 1 takes place parallel to an axis of rotation of the blade head 3.

Accordingly, as soon as the blade holder 1 is aligned/positioned on the traverse 13 by contact of the contact element 6 with the cutting edge of the lower blade 9, the blade holder 1 is fixed by means of the fixing device 15. For the following cutting process, the blade head 5 is automatically lowered (actuated) by means of the actuator 8.

The present invention contemplates providing a mechanism 11 which may be activated by a switch 2. The mechanism 11 is activated by the switch 2 as soon as the adjusting slide 5 is pivoted out of the starting position shown in the FIGS. 1 and 2. The switch 2 is coupled with the actuator 8 via the mechanism 11, such that (automatic) lowering (actuation) of the blade head 3 is prevented, when the switch 2 is activated. For example, the mechanism 11 activated by switch 2 interrupts the power supply 12 to the actuator 8.

Figure 7:
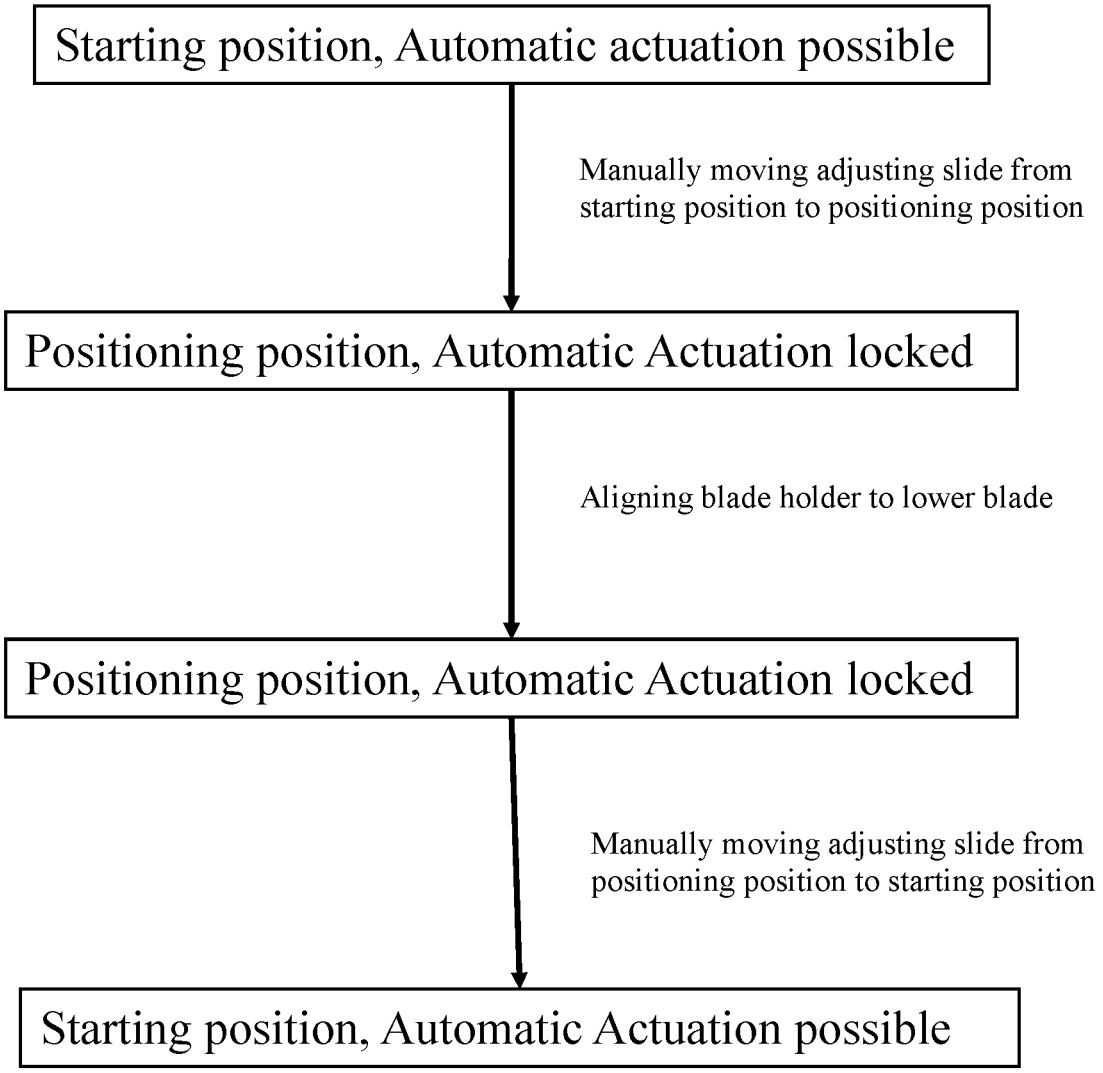
FIG. 7 is a schematic representation of the general method steps and states of the blade holder.

Accordingly, as indicated in FIG. 7 the present invention contemplates that the blade head 3 cannot be automatically actuated by the actuator 8 as long as the adjusting slide 5 is moved out of its starting position. Thus, the blade holder 1 can only can be used for a cutting process when the adjusting slide 5 is moved back again into its starting position. In this manner, the lower blade 9 is prevented from being damaged by the adjusting slide 5 that has moved out of its starting position during an aligning process of the blade head 3.

The features of the subject matter of this invention set forth in the above description, the patent claims, the abstract and the drawings can be used individually and in any desired combination for the realization of the invention in its various embodiments.

The present invention is, of course, in no way restricted to the specific disclosure of the specification and drawings, but also encompasses any modifications within the scope of the appended claims.

REFERENCE NUMERALS

1 blade holder
2 switch
3 blade head
4 circular blade
5 adjusting slide
6 contact element
7 cutting machine
8 actuator
9 lower blade
10 cutting edge of lower blade
11 locking mechanism
12 energy supply
13 traverse
14 further reference surface
15 fixing device
16 dovetail guide
17 clamping element
18 cutting edge of circular blade

I claim:

1. A blade holder (1) for a longitudinal cutting machine, comprising:

a rotatably mounted blade head (3) for holding a circular blade (4);

at least one fixing device (15);

at least one actuator (8) for actuation of an element of the blade holder (1) electro-mechanically, hydraulically, or pneumatically; and a movably mounted adjusting slide (5) having a contact element (6) for positioning the blade head (3) relative to the longitudinal cutting machine, wherein the adjusting slide (5) is moveable manually from a starting position to a positioning position for positioning of the blade head (3), wherein, in the positioning position, the contact element (6) is positioned to be brought in contact with a cutting edge (10) or another reference surface of a lower blade (9);

a switch (2) configured to be activated by the adjusting slide (5) when the adjusting slide (5) is moved out of the starting position; and a mechanism (11) electronically connected to the switch (2), wherein the switch (2) in an activated state triggers the mechanism (11), the mechanism (11) having a locking element that is movable to mechanically prevent actuation and movement of the blade holder (1) when the adjusting slide is moved out of the starting position.

2. The blade holder (1) according to claim 1, wherein the locking element is pneumatically driven to prevent actuation of the blade holder (1) when the adjusting slide (5) is moved out of the starting position.

3. The blade holder (1) according to claim 1, wherein the blade head (3) is linearly adjustable in the direction of an axis of rotation of the blade head (3).

4. The blade holder (1) according to claim 1, wherein the blade head (3) is adjustable transverse to an axis of rotation of the blade head (3).

5. The blade holder (1) according to claim 1, wherein the adjusting slide (5) is pivotably mounted.

6. A longitudinal cutting machine (7) with a plurality of blade holders (1) according to claim 1, wherein the blade holders (1) are held as upper blades on a continuous traverse (13) of the longitudinal cutting machine (7) and each of the multiple blade holders (1) is associated with at least one lower blade (9).

7. The longitudinal cutting machine according to claim 6, wherein actuation of the cutting machine (7) is prevented when the adjusting slide (5) of an individual blade holder (1) is moved out of the starting position.

8. A blade holder (1) for a longitudinal cutting machine, comprising:

a rotatably mounted blade head (3) for holding a circular blade (4);

at least one fixing device (15);

at least one actuator (8) for actuation of an element of the blade holder (1) electro-mechanically, hydraulically, or pneumatically;

a movably mounted adjusting slide (5) having a contact element (6) for positioning the blade head (3) relative to the longitudinal cutting machine, wherein the adjusting slide (5) is moveable manually from a starting position to a positioning position for positioning of the blade head (3), wherein, in the positioning position, the contact element (6) is positioned to be brought in contact with a cutting edge (10) or another reference surface of a lower blade (9);

a switch (2) configured to be activated by the adjusting slide (5) when the adjusting slide (5) is moved from the starting position;

a mechanism electronically connected to the switch, wherein the switch (2) in an activated state triggers the mechanism (11), wherein the mechanism (11) is configured to electrically and/or electronically prevent actuation of the blade holder (1) when the adjusting slide (5) is moved out of the starting position.

9. A blade holder (1) for a longitudinal cutting machine, comprising:

a rotatably mounted blade head (3) for holding a circular blade (4);

at least one fixing device (15);

at least one actuator (8) for actuation of an element of the blade holder (1) electro-mechanically, hydraulically, or pneumatically;

a movably mounted adjusting slide (5) having a contact element (6) for positioning the blade head (3) relative to the longitudinal cutting machine, wherein the adjusting slide (5) is moveable manually from a starting position to a positioning position for positioning of the blade head (3), wherein, in the positioning position, the contact element (6) is positioned to be brought in contact with a cutting edge (10) or another reference surface of a lower blade (9);

a switch (2) configured to be activated by the adjusting slide (5) when the adjusting slide (5) is moved out of the starting position;

a mechanism electronically connected to the switch, wherein the switch (2) in an activated state triggers the mechanism (11), wherein the mechanism (11) is configured to interrupt an energy supply (12) to the at least one actuator (8) of the blade holder (1) via a relay.

* * * * *